US006605349B2

(12) United States Patent
Phillips

(10) Patent No.: US 6,605,349 B2
(45) Date of Patent: Aug. 12, 2003

(54) DEFORMABLE, SHRINKABLE FIBER AND A PROCESS FOR THE MAKING THEREOF

(75) Inventor: Bobby Mal Phillips, Jonesborough, TN (US)

(73) Assignee: Clemson University Research Foundation, Clemson, SC (US)

( * ) Notice: Subject to any disclaimer, the term of this patent is extended or adjusted under 35 U.S.C. 154(b) by 0 days.

(21) Appl. No.: 10/224,439

(22) Filed: Aug. 19, 2002

(65) Prior Publication Data

US 2003/0044601 A1 Mar. 6, 2003

Related U.S. Application Data

(60) Provisional application No. 60/316,195, filed on Aug. 30, 2001.

(51) Int. Cl.[7] ..... D01F 8/00; A61F 13/15

(52) U.S. Cl. ..... 428/372; 428/373; 604/370; 604/372

(58) Field of Search ..... 428/372, 373; 604/370, 372

(56) References Cited

U.S. PATENT DOCUMENTS

| | | | | |
|---|---|---|---|---|
| 4,235,237 | A | 11/1980 | Mesek et al. | 128/284 |
| 4,357,938 | A | 11/1982 | Ito et al. | 128/287 |
| 4,381,782 | A | 5/1983 | Mazurak et al. | 604/368 |
| 4,447,240 | A | 5/1984 | Ito et al. | 604/385 |
| 4,500,315 | A | 2/1985 | Pieniak et al. | 604/379 |
| 4,573,988 | A | 3/1986 | Pieniak et al. | 604/379 |
| 4,699,823 | A | 10/1987 | Kellenberger et al. | 428/219 |
| 4,935,022 | A | 6/1990 | Lash et al. | 604/368 |
| 4,942,089 | A | 7/1990 | Genba et al. | 428/364 |
| 5,180,622 | A | 1/1993 | Berg et al. | 428/192 |
| 5,200,248 | A | 4/1993 | Thompson et al. | 428/131 |
| 5,242,644 | A | 9/1993 | Thompson et al. | 264/177.15 |
| 5,268,229 | A | 12/1993 | Phillips et al. | 428/400 |
| 5,567,796 | A | 10/1996 | Nakatsukasa et al. | 528/272 |
| 5,611,981 | A | 3/1997 | Phillips et al. | 264/130 |
| 5,643,238 | A | 7/1997 | Baker | 604/368 |
| 5,723,159 | A | 3/1998 | Phillips et al. | 425/461 |
| 5,753,166 | A | 5/1998 | Dalton et al. | 264/177.13 |
| 5,855,798 | A | 1/1999 | Phillips et al. | 210/767 |
| 5,972,505 | A | 10/1999 | Phillips et al. | 428/397 |
| 5,977,429 | A | 11/1999 | Phillips et al. | 604/370 |
| 6,103,376 | A | 8/2000 | Phillips et al. | 428/397 |

*Primary Examiner*—N. Edwards
(74) *Attorney, Agent, or Firm*—Kennedy Covington Lobdell & Hickman, LLP

(57) ABSTRACT

A deformable, shrinkable fiber that is dimensionally stable at normal body temperatures of approximately 37° C. in the dry state, but is dimensionally unstable (i.e. shrinks and distorts) when wet at the same temperature. The fiber comprises a fiber forming polymer that has a dry glass transition temperature ("dry Tg") of greater than or equal to 42° C. and a wet glass transition temperature ("wet Tg") of less than or equal to 32° C. A method of making said fiber and absorbent article(s) made therefrom are also disclosed.

12 Claims, 1 Drawing Sheet

DEFORMABLE, SHRINKABLE FIBER AND A PROCESS FOR THE MAKING THEREOF

CROSS-REFERENCE TO RELATED APPLICATIONS

This application claims the benefit of U.S. provisional application Ser. No. 60/316,195, filed Aug. 30, 2001.

FIELD OF THE INVENTION

The present invention relates to a deformable, shrinkable fiber that is stable at body temperatures in the dry state but shrinks and distorts when it contacts body fluids such as urine and menses which are at body temperature in the wet state. The present invention also relates to a process for making the fiber and articles made of the fiber.

BACKGROUND OF THE INVENTION

There is a continual desire to develop thinner diapers, feminine hygiene products, and adult incontinent products. A thinner product is less bulky to wear, fits better under clothing, is less noticeable and is more compact to package and carry. However, a problem exists which inhibits the development of thinner diapers, feminine hygiene products, and adult incontinent products. This problem is commonly referred to as "gel blocking." Gel blocking occurs when particles of a superabsorbent polymer ("SAP") are wetted and the particles swell, inhibiting fluid transmission to other regions of the absorbent article. Leakage from the absorbent article can occur before achieving maximum use of the SAP or before the fluid can diffuse past the blocking particles into the remainder of the absorbent article. Gel blocking typically occurs in absorbent articles containing high levels, typically 30 to 40%, of SAP and higher. SAP is typically blended with cellulose fluff pulp or modified cellulose pulps. The problem is most prevalent when the level of SAP exceeds 40% by weight in these blends. The continuous barrier formed by the gel prohibits additional penetration of the structure by more fluid, thus sealing much of the SAP from the fluid. The end result is that the maximum benefit of the product is not achieved.

U.S. Pat. Nos. 4,235,237; 4,381,782; 4,500,315; 4,573,988; 4,699,823; 4,935,022; 5,180,622; and 5,643,238 disclose various attempts to reduce gel blocking and its impact on fluid acquisition and storage.

The articles of the present invention employ shrinkable fibers yet eliminate gel blocking. Attempts have been made in the past to use shrinkable fibers in products such as diapers but such attempts have been unsuccessful in eliminating the problem of gel blocking.

U.S. Pat. No. 4,357,938 discloses a disposable diaper comprising a water-absorbing layer located between a liquid-permeable surface sheet and a liquid impermeable backing sheet, wherein water-absorbing shrinkable fibers are fixed to and extend along the central portion in the lengthwise direction of the disposable diaper in such a manner that the water-absorbing shrinkable fibers are not placed on top of the water-absorbing layer, and wherein means is provided so that the water-absorbing shrinkable fibers become wetted when the diaper is wetted, the water-absorbing shrinkable fibers exhibiting a percent shrinkage of at least 15% and a shrinking force of at least 100 g when the fibers are wetted.

U.S. Pat. No. 4,447,240 discloses a disposable diaper which comprises a liquid-permeable surface sheet, a liquid-impermeable back face sheet and a water-absorbing layer disposed between said sheets, wherein water-absorbing shrinkable fibers, the length of which is reduced on contact with water to impart elasticity to the fibers, are fixed across the central portion in the lengthwise direction of the disposable diaper without being lapped over the water-absorbing layer and the water-absorbing layer is connected to said water-absorbing shrinkable fibers by cellulose fibers.

U.S. Pat. No. 4,942,089 discloses a rapidly shrinking fiber made from modified polyvinyl alcohol wherein the fiber is capable of rapidly shrinking when coming into contact with water at ordinary temperature and capable of maintaining the fiber form and exhibiting rubber elasticity.

U.S. Pat. No. 5,567,796 discloses a polyester filament or fiber, when drawn under selected conditions, has a high shrinkage ratio but also a high shrinkage stress.

In contrast to the patents cited above, use of the fibers of the present invention will enable development and production of thinner absorbent products as well as more efficient use of SAP in existing products by reducing the effects of gel blocking.

SUMMARY OF THE INVENTION

The present invention relates to a deformable, shrinkable fiber that is dimensionally stable at normal body temperatures of approximately 37° C. in the dry state, but is dimensionally unstable (i.e. shrinks and distorts) when wet at the same temperature.

In one embodiment of the present invention a fiber forming polymer is selected that has a dry glass transition temperature ("dry Tg") of greater than or equal to 42° C. and a wet glass transition temperature ("wet Tg") of less than or equal to 32° C.

The present invention also relates to a method of preparing said shrinkable fiber, and an absorbent article(s) comprising said fiber.

DETAILED DESCRIPTION OF THE INVENTION

The present invention relates to a deformable, shrinkable fiber that changes dimensions when becoming wet at normal body temperatures and to absorbent articles made therefrom. Preferably, the present invention relates to a short, oriented shrinkable fiber. Surprisingly, the use of these fibers reduces gel blocking in absorbent articles such as diapers, feminine hygiene products, and adult incontinent products.

The fiber of the present invention has a dry glass transition temperature (dry TG) equal to or greater than 42° C. and a wet glass transition temperature (wet TG) of less than or equal to 32° C. Also, the fiber is shrinkable by at least 10% when exposed to the wet state. The lower the wet TG, the better the desired behavior. The dimensional changes that occur upon shrinkage need to happen in less than thirty seconds and preferably less than ten seconds, and the forces generated during the shrinking need to be greater than 100 mg/denier. These forces are required to overcome the frictional resistance to movement experienced by the fiber when blended with SAP and/or fluff pulp, and thereby, open up the pathways to allow the fluid to defeat gel blocking. Shrinkage forces can be measured on standard Instron testing machines with controlled temperature/environment chambers for the samples. Also numerous methods are available to measure the glass transition temperatures in polymers. ASTM test method NO. D3418 describes procedures for measuring both dry Tg and wet Tg.

Although it is within the teachings of the present invention to vary the size, shape and length of the fiber, the fiber of the present invention preferably has a denier per filament ("dpf") between about 3 and 100. A dpf of greater than 15 is most preferred. The shape of the fiber may be round or nonround. However, nonround shapes are preferred. Examples of preferred nonround shapes include, but are not limited to, those disclosed in U.S. Pat. No. 5,200,248, U.S. Pat. No. 5,242,644, U.S. Pat. No. 5,268,229, U.S. Pat. No. 5,611,981, U.S. Pat. No. 5,723,159, U.S. Pat. No. 5,753,166, U.S. Pat. No. 5,855,798, U.S. Pat. No. 5,972,505, U.S. Pat. No. 5,977,429, and U.S. Pat. No. 6,103,376, which are incorporated herein by reference.

Figure 1A:
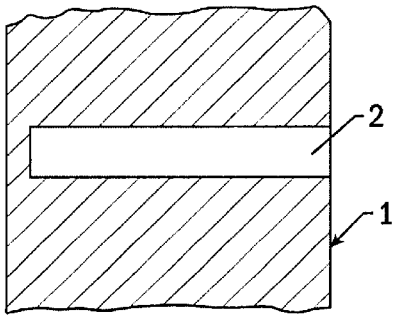
FIG. 1A is a partial sectional view showing bore detail for an aperture of a spinneret that may be used in accordance with the present invention.

FIG. 1A is a partial sectional view showing the bore 2 for an aperture of the spinneret 1 that may be used in Example 1 in accordance with the present invention.

Figure 1B:
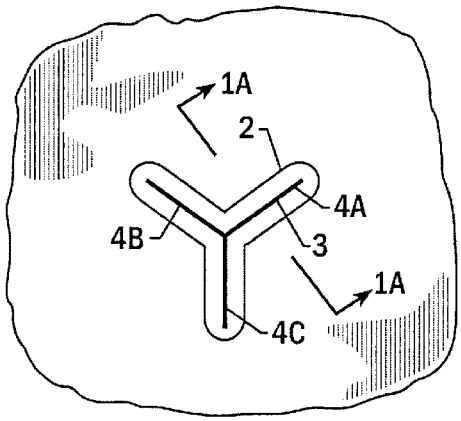
FIG. 1B is a plan view showing a bore and an aperture of a spinneret that may be used in accordance with the present invention.

FIG. 1B shows an aperture 3 in the bore 2 and having the arms 4A, 4B and 4C.

Figure 1C:
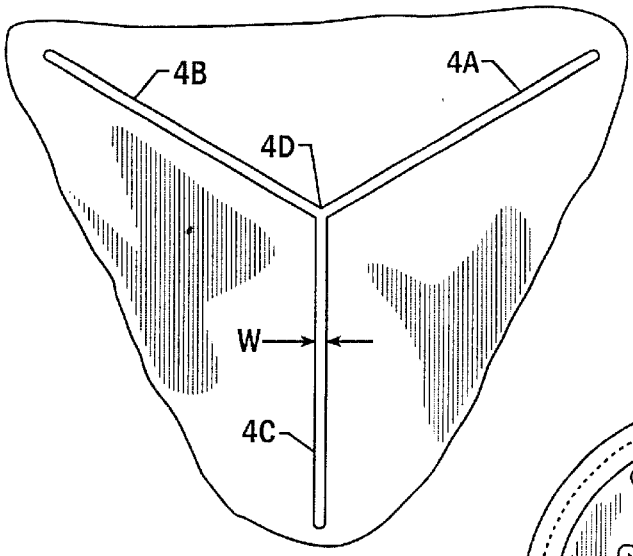
FIG. 1C is a schematic showing the relative dimensions of an aperture of a spinneret that may be used in accordance with the present invention.

FIG. 1C is a schematic showing the dimension of aperture 3 of the spinneret 1 that may be used in Example 1. FIG. 1C shows that the arms 4A, 4B and 4C all radiate from a common axis 4D and radiate at angles spaced by 120° from one another. FIG. 1C also shows that the arms 4A, 4B and 4C have lengths that are 150 times their width, W. The width W is 0.067 millimeters in aperture 3.

Figure 1D:
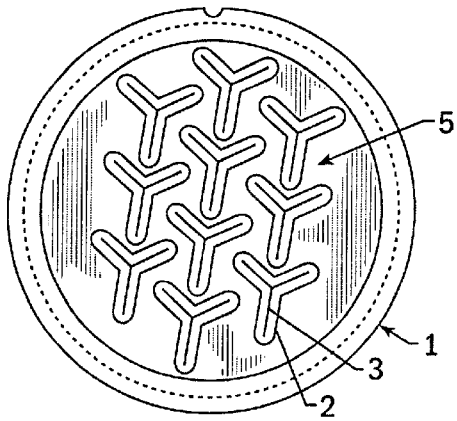
FIG. 1D is a plan view of an interior face of the spinneret showing a bore and an aperture pattern that may be used in accordance with present invention.

FIG. 1D shows a spinneret 1 that may be used in example 1 having the bores 2 and the apertures 3 in the aperture pattern 5. The apertures 3 in the pattern 5 are aligned in three rows such that the center points for apertures in each row define a line.

The term "short" in reference to the fiber means that the length of the fiber is less than one inch. A length of a half inch or a quarter inch is particularly preferred.

The term "shrinkable" as used in the context of the present invention means that the fiber will shrink at least 10% when exposed to water at 37° C. Preferably, the fiber will shrink greater than 25%.

The term "oriented" as used in the context of the present invention means the relative alignment of the polymer molecules in the fiber. This orientation is developed in the fiber by attenuating the fiber as it cools through the dry Tg during spinning and by stretching the fiber during classic drawing of the fiber. The relaxing of the orientation trapped within the fiber by applying wet heat (temperature of body fluids) allows for shrinkage to occur.

The term "nonround" as used in the context of the present invention refers to the non-circular nature of the fiber cross section. One useful characterization of the cross sectional shape is referred to as the Shape Factor and is defined as $$\text{Shape Factor} = \frac{P}{(4\Pi A_f)^{0.5}}$$

where

P is the perimeter of the cross section of the fiber $A_f$ is the cross sectional area of the fiber Round fibers have a shape factor of 1. The preferred fibers of the present invention have shape factors greater than 2 and more preferably in the 3–6 range. The bulkier (the higher shape factor) the fiber the more space it can create when it shrinks to provide the pathways for the fluid to defeat the gel block.

Examples of polymers suitable for use in the present invention include, but are not limited to, polyamides and polyesters having a dry glass transition temperature (dry Tg) equal to or greater than 42° C. and a wet glass transition temperature (wet Tg) of less than or equal to 32° C. In particular, preferred polymers include nylons such as nylon-6,10, modified nylons, polyesters and modified polyesters. For example, polyethylene terephthalate ("PET") may be modified with diethylene glycol and isothalate polyesters may be modified with diethylene glycol to produce the desired glass transition temperatures. However, variations in the polymers of which these fibers are comprised are also possible within the teachings of the present invention.

The fibers of the present invention are particularly useful in blends of fluff pulp and superabsorbent polymer. Preferably, blends comprise up to 50% by weight of the fiber. The fluff pulp is preferably cellulose fluff pulp. The fluff pulp may be chemically modified. More preferably, the blend comprises 5% to 25% of the fiber. An advantage of the fibers of the present invention is that these fibers when blended up to 50% by weight with SAP and fluff pulp, distort and form open channels which allow additional fluid to penetrate the absorbent structure and reduce gel blocking. The use of a blend comprising the fiber of the present invention in an absorbent product is one method of reducing gel blocking.

The fibers of the present invention can be made on conventional PET staple fiber production equipment or similar polyamide staple fiber production equipment. Typically for a modified PET polymer, the polymer must be dried, heated above its melting point for polymers with crystalline melting points or heated to a viscosity suitable for fiber formation for amorphous polymers, extruded through a spinneret with the cross section of choice, quenched and attenuated, lubricated, further attenuated if necessary, cut to the final desired length and packaged for shipment.

The fibers of the present invention can be blended with other fibers and polymers including, but not limited to, SAP, cellulose fluff pulp, and modified cellulose fluff pulp. Preferably, the blend comprises at least 40% SAP.

PROPHETIC EXAMPLES

Prophetic Example 1

Polyethylene terephthalate modified with 45 mole % diethylene glycol (DEG) having an IV of 0.60 may be melt spun into fiber at 150° C. using conventional PET fiber production equipment and a spinneret such as shown in FIGS. 1A–1D. Fibers having a dpf of twenty-five may be taken up at 1000 m/min. These fibers may be lubricated and cut to ½ inch length. These fibers may then be blended at the 25% level with 50% SAP powder and 25% fluff pulp. The blend is expected to have a reduced tendency to gel block when compared to a 50/50 blend of SAP and fluff pulp.

PROPHETIC EXAMPLE 2

Prophetic Example 1 may be repeated except that a round cross sectional fiber is produced. The same blend level experiment as shown in Prophetic Example 1 is expected to confirm the reduced tendency to gel block although not as much as using the nonround cross sectional fibers of Prophetic Example 1.

What is claimed is:

1. A deformable, shrinkable fiber comprising a polymer having a dry glass transition temperature equal to or greater than 42° C. and a wet glass transition temperature less than or equal to 32° C.

2. The fiber as claimed in claim 1, wherein the fiber is short and oriented and has a shape factor greater than 2.

3. The fiber as claimed in claim 1, wherein the fiber has a denier per filament between about 3 and 100.

4. The fiber as claimed in claim 3, wherein the fiber has a denier per filament of greater than about 15.

5. The fiber as claimed in claim 1, wherein the fiber has a round or nonround cross-section.

6. The fiber as claimed in claim 1, wherein the fiber is blended with a super absorbent polymer.

7. The fiber as claimed in claim 6, wherein the blend comprises at least 40% super absorbent polymer.

8. The fiber as claimed in claim 1, wherein the fiber is blended with a super absorbent polymer and a cellulose fluff pulp.

9. The fiber as claimed in claim 8, wherein the blend comprises at least 40% super absorbent polymer.

10. An absorbent article comprising a deformable, shrinkable fiber wherein the fiber has a dry glass transition temperature equal to or greater than 42° C. and a wet glass transition temperature less than or equal to 32° C.

11. An absorbent article comprising the blend of claim 9.

12. An absorbent article comprising the blend of claim 8.

* * * * *